United States Patent [19]

Andreasen

[11] Patent Number: 4,514,793

[45] Date of Patent: Apr. 30, 1985

[54] REFLECTOR SYSTEM FOR SECURING TO A LIGHT SOURCE

[76] Inventor: Knud Andreasen, Alfr. Christensens Vej 11, 2850 Naerum, Denmark

[21] Appl. No.: 531,833

[22] PCT Filed: Dec. 13, 1981

[86] PCT No.: PCT/DK82/00111

§ 371 Date: Aug. 2, 1983

§ 102(e) Date: Aug. 2, 1983

[87] PCT Pub. No.: WO83/02145

PCT Pub. Date: Jun. 23, 1983

[30] Foreign Application Priority Data

Dec. 15, 1981 [DK] Denmark ..... 3511/81

[51] Int. Cl.[3] ..... F21V 7/00

[52] U.S. Cl. ..... 362/306; 362/341; 362/347; 362/362; 362/377; 362/396; 362/417; 362/444

[58] Field of Search ..... 362/306, 341, 347, 362, 362/377, 396, 417, 444

[56] References Cited

U.S. PATENT DOCUMENTS

| | | | |
|---|---|---|---|
| 1,903,985 | 4/1933 | De Sherbinin | 362/444 |
| 2,103,322 | 12/1937 | De Sherbinin | 362/444 |
| 2,300,915 | 11/1942 | Florence | 362/396 X |
| 2,304,445 | 12/1942 | Doane | 362/396 X |
| 2,434,440 | 1/1948 | Schafranek | 362/396 X |
| 2,446,461 | 8/1948 | Diver | 362/396 X |
| 2,524,173 | 10/1950 | Peterson | 362/396 X |
| 2,741,694 | 4/1956 | Thomstad et al. | 240/51.11 |
| 2,759,097 | 8/1956 | Kornan et al. | 240/138 |
| 4,214,688 | 7/1980 | Griffin | 362/396 X |

FOREIGN PATENT DOCUMENTS

| | | |
|---|---|---|
| 5775/76 | 12/1976 | Denmark . |
| 2410037 | 9/1974 | Fed. Rep. of Germany . |
| 85656 | 4/1955 | Norway . |
| 89501 | 5/1957 | Norway . |
| 91503 | 2/1958 | Norway . |
| 125976 | 9/1949 | Sweden . |
| 312379 | 8/1968 | Sweden . |
| 365600 | 5/1970 | Sweden . |
| 884068 | 12/1961 | United Kingdom . |

*Primary Examiner*—Stephen J. Lechert, Jr.
*Attorney, Agent, or Firm*—Merchant, Gould, Smith, Edell, Welter Schmidt

[57] ABSTRACT

When it is desired to increase the light yield from fluorescent tube installations without reflectors by providing the fluorescent tubes with a reflector, it is often difficult to mount and position the reflector in an existing light fitting, and it is even more difficult when such fluorescent tubes sit freely on a wall or a ceiling, or are mounted externally on a fitting.

For this purpose the reflector system comprises a reflector (4) of anodized aluminium and securing elements (1) consisting of spring straps which surround the fluorescent tube (5) and secure the reflector (4) to the fluorescent tube by means of friction between the securing element's strap (1) and the fluorescent tube (5).

Also provided is a second embodiment of the securing element which is intended for fittings with a flat surface. In this case the securing element has some protruding ends which bear against the flat surface of the fitting and thus position and secure the reflector in the correct position.

4 Claims, 5 Drawing Figures

REFLECTOR SYSTEM FOR SECURING TO A LIGHT SOURCE

Figure 1:
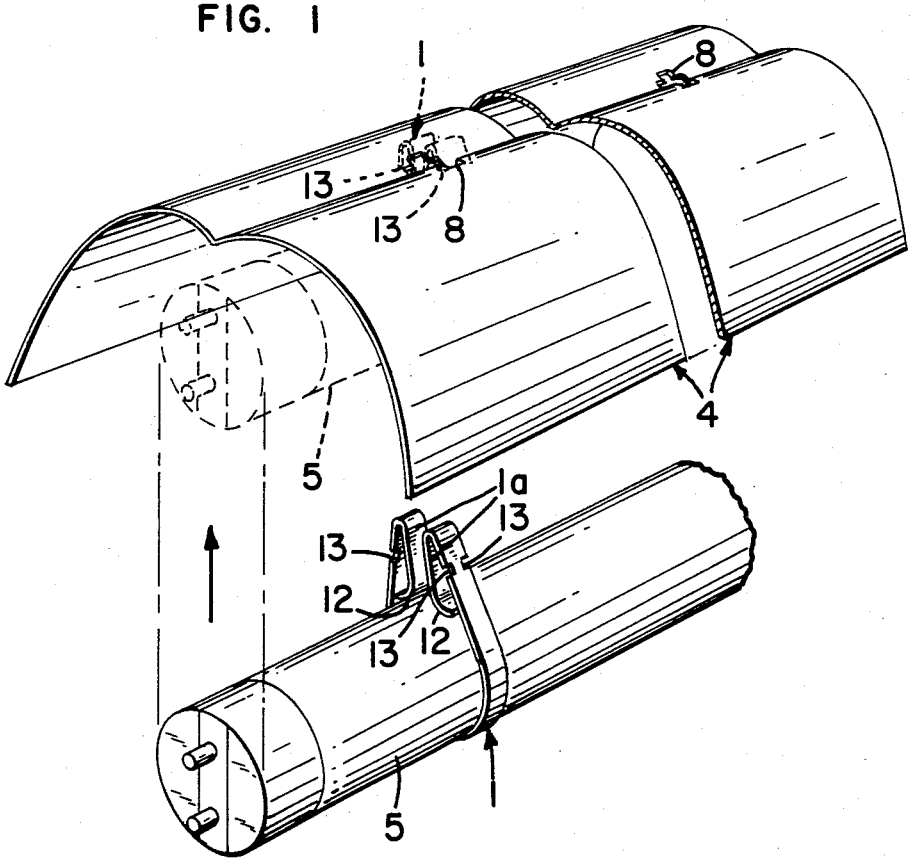

This invention relates to a reflector system for securing to a light source.

Reflectors for lighting purposes are most often manufactured of anodized aluminium plate and are secured to the light fitting, in that the reflectors are normally produced especially for use in connection with the individual types of fittings.

However, many light sources are to be found, for example fluorescent tubes, which are mounted in fittings without reflectors or which are disposed freely outside the fitting. When for reasons of increasing energy prices it is desired to increase the illumination without exchanging the lamps for lamps having a greater energy consumption, one can provide them with suitable light reflectors. In order to make the assembly independent of the shape of the fitting, it is most expedient for the reflector to be mounted directly on the light source.

Reflectors for mounting directly on to fluorescent tubes are known, for example executed in plastic materials and provided with various means of reflection. It is, however, more expedient to produce the reflector of anodized pure aluminum, the reason being that this material is more robust and stable in shape and, furthermore, its reflecting characteristics are more durable.

In the following, the invention is explained in connection with the use of an elongated light source, and a normal fluorescent tube has been chosen as an example.

The actual cross-sectional curve of the reflector, which does not form a direct part of the present invention, conforms mainly to that shape known, for example, from British Pat. No. 884,068, the lower part of the reflector cross-sectional curve turning downwards to form a light output aperture which strongly reduces the light intensity immediately outside an angle which is desired to limit the transmission of light transversely to the fitting. The shape of this part of the reflector cross section is known from textbooks and from pending Danish patent application No. 5775/76.

However, between these two parts of the reflector cross section there is inserted a straight part, or an approximately straight part, from that point on the involute curve to the light source cross section in the same plane, from which a half-tangent to the light source is parallel—for symmetrical reflectors—to the plane of symmetry.

This straight part in the reflector cross section continues so far that the light intensity in directions near the reflector's plane of symmetry is so much less than the intensity of light at greater angles from the plane of symmetry that the light transmission results in a focal point relationship which, according to the BZ system, is greater than 0.7 at S/Hm=1.5.

Therefore, there is no real continuity in the transition between the types of curves used, and several of the remaining characteristics displayed in the shaping of the reflector according to Danish patent application No. 5775/76 do not apply to the reflector as described here.

The reflector system according to the invention will, however, display optimum characteristics with regard to energy loss, outer dimensions and glare, and also the improvement in the application possibilities which lies in the fact that it will provide good regularity in the illumination, even when the light fittings hang spread with S/Hm=1.5.

This improvement is necessary for the reason that the regularity of the illumination must not be diminished in the mounting of reflectors on existing installations.

Reflectors of the above-mentioned shape are difficult to mount in existing fittings which do not already have reflectors, and on completely freely-disposed fluorescent tubes.

The object of the invention is to provide a reflector system consisting of a reflector of the correct shape, for example of anodized aluminium plate, which is cheap to produce, and also to provide securing elements which are similarly simple and thus also cheap to produce. Moreover, with lighting installations, it is important that after having been fitted with reflectors that the installation maintains a reasonable aesthetic standard, and at the same time that the reflector system is simple and quick to mount. This is achieved by forming the reflector system as characterized in claim 1.

If the light source is of the type which sits in a fitting, in certain cases one can utilize a flat surface in the fitting so that the reflector sits correctly in relation to the light source, and at the same time it will be correctly positioned in relation to the fitting and the direction of illumination. This is effected in an expedient manner by designing the securing element for the reflector system as presented in claim 2.

If, however, the light source sits freely outside the fitting or externally on the fitting, or if the fitting does not have a reasonably flat surface of contact, the reflector system according to claim 3 can be used, in that here it is secured exclusively on the light source.

By designing the reflector system's securing element as presented in claim 4, it is possible to secure the reflector without the securing element actually clamping around the fluorescent tube, but instead being merely supported by the fluorescent tube.

On the other hand, if the reflector system's securing element is designed as presented in claim 5, the result is that the securing element clamps tightly around the fluorescent tube and, in this manner, tightly secures the reflector.

The securing element is provided with gripper recesses, whereby a well-defined friction is achieved between the strap of the securing element and the fluorescent tube it surrounds.

The invention will now be described with reference to the drawing, where

Figure 5:
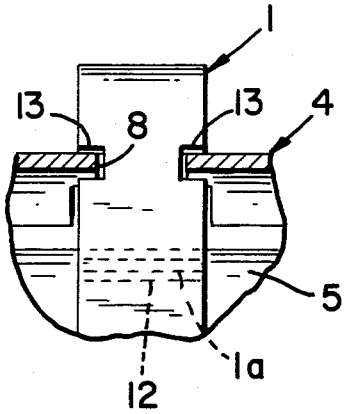
Figure 2:
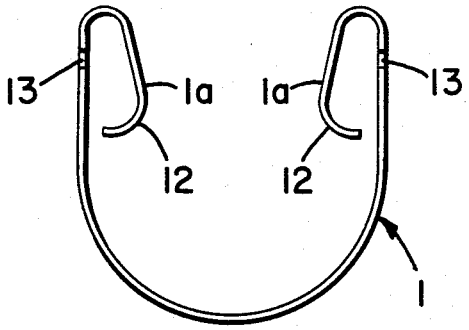
Figure 3:
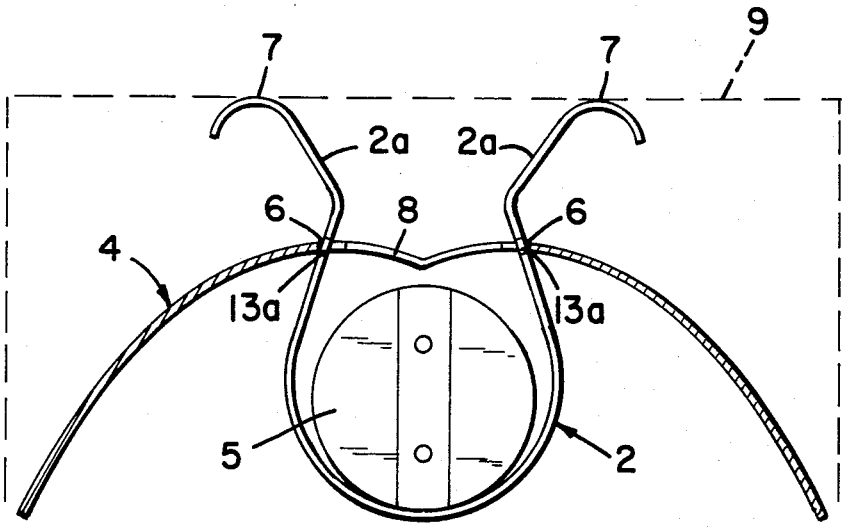
Figure 4:
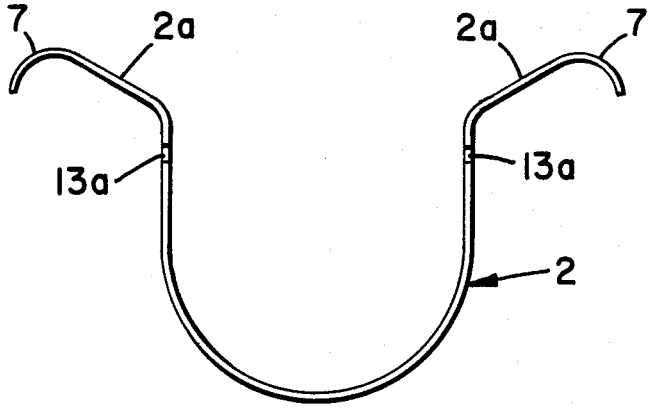

FIG. 1 shows a reflector system according to the invention in an embodiment intended for securing directly on to a fluorescent tube, FIG. 2 shows a securing element for the reflector system shown in FIG. 1, FIG. 3 shows a reflector system according to the invention in an embodiment intended for securing to a fluorescent tube mounted in a fitting, FIG. 4 shows a securing element for the reflector system shown in FIG. 3, and FIG. 5 shows a fragmentary detailed sectional view of a securing element in place on a reflector and a fluorescent tube.

In sketch form in FIGS. 1 and 2 will be seen a reflector system intended for mounting directly on, for example, a fluorescent tube which sits freely mounted, for example on a wall or a ceiling, or externally on a fitting. One or more securing elements 1 surround the fluorescent tube and are secured to the reflector 4 in assembly holes 8. The assembly hole 8, also called the gripping hole, is formed and positioned in the reflector's lengthwise central axis and is shown in detail in FIG. 5. The securing element 1 has gripping recesses 13 at the ends at which the securing element 1 is bent, thus enabling it to be secured in the assembly hole 8 as shown in FIG. 1. The securing element 1 surrounds the fluorescent tube 5 with sufficient friction to secure the reflector 4 in a certain position. This friction, however, is no greater than one can turn the reflector 4 if this has been placed in a slightly crooked manner on the light source. Together with that part of the securing element 1 which surrounds the light source, it is the bent ends 1*a* which at point 12 have flexible connection with the light source which provide the necessary friction. The bent ends 1*a* of the securing element, see FIG. 2, reach right in and support against that part of the securing element which lies as a tangent to the fluorescent tube, see FIG. 1.

In FIGS. 3 and 4 is shown a second embodiment of the invention, this embodiment being particularly suitable for mounting on fluorescent tubes which are placed in a fitting with a flat surface, which in the drawing is represented by the stippled line in FIG. 3. For the sake of clarity, in FIG. 3 the reflector system is shown as seen in transverse section. Here, the reflector 4 is secured by a securing element 2, see FIG. 4, which surrounds the light source 5 and passes through a hole 8 in the reflector 4. At point 6 the reflector is held firmly in the gripping recesses 13*a* in the securing element 2 which bears against the fitting 9 at points 7. The securing element substantially surrounds the light source so that there is no friction against the light source, in that the reflector 4 will of course always sit in the correct position. When the ends 2*a* of the securing element 2 bear up against the fitting 9, they are influenced in such a way that they slide slightly away from each other. The pressure with which the reflector 4 and the securing element 2 lie up against the fluorescent tube is determined by the moment which arises due to the flexible contact of the quite long and springy ends against the fitting.

The reflectors 4 used in the embodiments shown in both FIG. 1 and FIG. 3 are the same, in that the holes provided in the reflector 4 are of such a shape that the gripping recess 13 in the securing element 1 or 2 engages in the holes 8. The securing elements as shown in FIGS. 2 and 4 are also essentially the same, their bent ends 1*a* and 2*a* merely being bent differently. The length of the securing element naturally depends on the type of light source on which the reflector is to be mounted. The securing element is normally made of metal, for example thin metal plate of spring steel, but other flexible materials can also be used.

Although the invention has been explained and shown in connection with a fluorescent tube, it is obvious that the reflector system according to the invention can be used on other types of elongated light sources. The reflector 4 can also be of other expedient shapes. It merely needs to be provided with suitable holes so that it can be secured by the gripping recesses 13, 13*a* in the securing elements.

What is claimed is:

1. A reflector system for securement above an elongated light source comprising a reflector having at least one pair of adjacent apertures, at least one mounting clip having a first circular portion adapted to partially encircle that light source including full encirclement of the lower portion of said source, said portion having two ends each extending generally upwardly into said pair of apertures, said clip including means for securely engaging said apertures to maintain said reflector suspended above and spaced from said light source despite gravitational forces.

2. A reflector system according to claim 1 wherein said apertures include slots and wherein each of said ends include gripping notches adapted to engage said slots in locking engagement, said ends including further bent ends which curve back toward said light source returning through said apertures.

3. A reflector according to claim 2 wherein said bent ends are further bent away from said light source at their extreme ends.

4. A reflector according to claim 1 wherein said apertures include slots and wherein each of said ends include gripping notches adapted to engage said slots in locking engagement, said ends including further protruding portions generally upwardly from said aperture so that the protruding portions may bear against a room ceiling.

* * * * *